United States Patent [19]

Moench et al.

[11] Patent Number: 4,754,592

[45] Date of Patent: Jul. 5, 1988

[54] COMPOSITE WINDOW

[75] Inventors: Julius Moench, Wendelstein; Wolfram Scheler, Rodach, both of Fed. Rep. of Germany

[73] Assignee: Siemens Aktiengesellschaft, Berlin and Munich, Fed. Rep. of Germany

[21] Appl. No.: 23,629

[22] Filed: Mar. 9, 1987

[30] Foreign Application Priority Data

Mar. 7, 1986 [DE] Fed. Rep. of Germany ... 8606345[U]

[51] Int. Cl.[4] ..... E04C 2/54

[52] U.S. Cl. ..... 52/790; 52/398; 52/172; 350/358; 350/262; 428/45; 428/46

[58] Field of Search ..... 52/397–400, 52/788, 203, 171, 304, 207, 204, 789, 790; 49/501; 350/258, 260, 262, 265; 428/45, 46, 48

[56] References Cited

U.S. PATENT DOCUMENTS

| | | | |
|---|---|---|---|
| 2,179,589 | 11/1939 | Dieterich | 52/398 |
| 2,231,514 | 2/1941 | Verhagen | 52/304 |
| 2,264,176 | 11/1941 | Englehart et al. | 52/208 |
| 3,750,358 | 8/1973 | Lewkowitz | 52/400 |
| 4,219,971 | 9/1980 | Mauroner | 49/425 |
| 4,557,570 | 12/1985 | Hines | 354/113 |
| 4,567,710 | 2/1986 | Reed | 52/790 |
| 4,654,243 | 3/1987 | Moench et al. | 428/46 |

FOREIGN PATENT DOCUMENTS

| | | | |
|---|---|---|---|
| 2060889 | 6/1971 | Fed. Rep. of Germany | 52/399 |
| 3513450.3 | 8/1985 | Fed. Rep. of Germany . | |
| 2110285A | 6/1983 | United Kingdom | 52/788 |
| 2147044A | 5/1985 | United Kingdom | 52/788 |

*Primary Examiner*—John E. Murtagh
*Assistant Examiner*—Andrew Joseph Rudy
*Attorney, Agent, or Firm*—Hill, Van Santen, Steadman & Simpson

[57] ABSTRACT

Prismatic plates are float-mounted between glass panes of a composite window by means of a spacer which is attached to the inside of a bridge which connects the glass panes. This attachment comprises a dove-tailed groove and a prismatic component which fits into the groove. This connection allows the components to be displaced in the event of thermal expansion and also permits easy assembly.

6 Claims, 1 Drawing Sheet

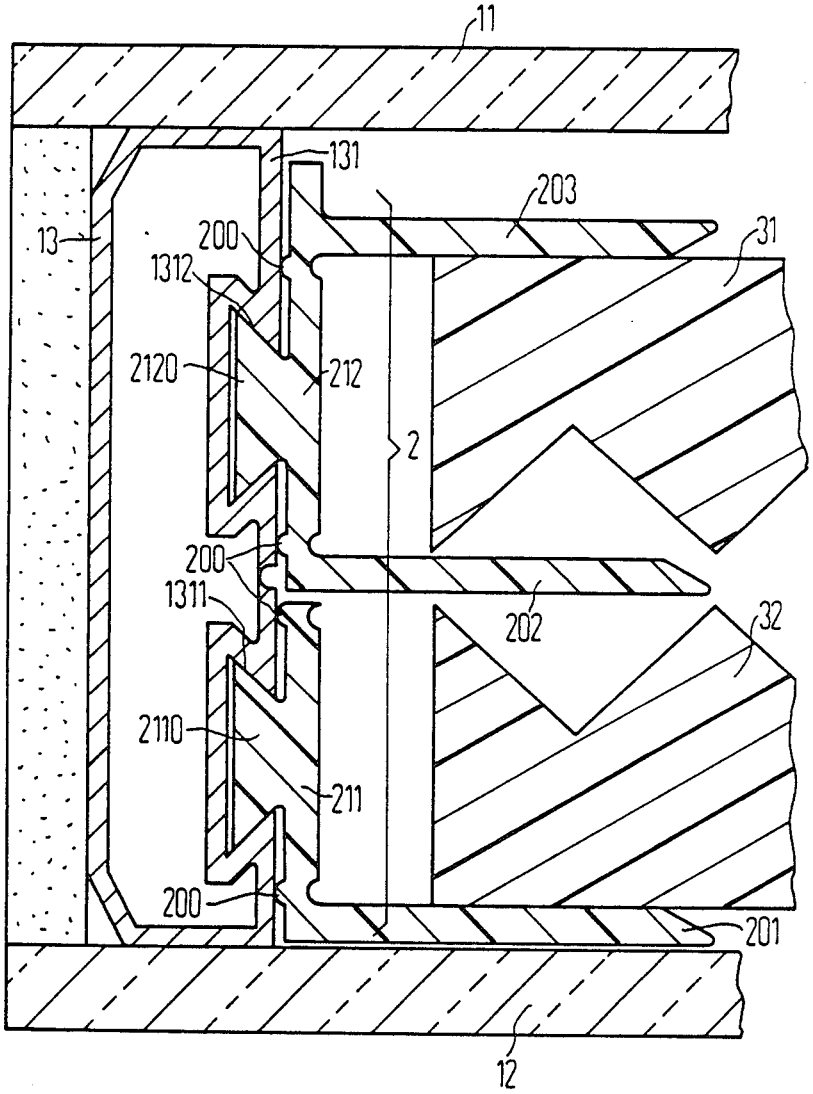
11
131
203
31
13
200
1312
2120
212
2
200
1311
202
32
2110
211
200
201
12

COMPOSITE WINDOW

BACKGROUND OF THE INVENTION

The invention relates to a composite window wherein first and second glass panes are provided which are connected to one another in sealed fashion at their edges by a bridge enclosing an interior space between the glass panes. A spacer structure is provided which supports at least one prismatic plate between the two glass panes by use of guide flanks extending parallel to the glass panes. The prismatic plate is float-mounted between these guide flanks.

In a composite window of this type, as disclosed in German Utility Pat. No. 85 13 450, corresponding to U.S. Pat. No. 4,654,243, issued Mar. 31, 1987, entitled "Device For Guiding Daylight", inventors Julius Moench, Heinz Rentzsch, Georg Lang and Herbert Mueller, incorporated herein by reference, a spacer is connected to a bridge via a fixed bearing and a movable bearing. In this known composite window, a reliably functioning movable bearing can be achieved only with substantial structural expense.

SUMMARY OF THE INVENTION

It is an object of the invention to improve upon the connection between the spacer and the bridge in such a manner so as to ensure continuous mobility between bridge and spacer in the event of thermally dependent longitudinal expansion, and to facilitate a simple assembly of the components.

According to the invention, a dove-tailed prismatic guide is provided which, on assembly, facilitates a simple interconnection of the components and, during the operation of the finished composite window, facilitates a thermally dependent displacement of the spacer relative to the bridge at all times.

BRIEF DESCRIPTION OF THE DRAWINGS

The Drawing FIGURE shows a preferred embodiment of the invention in cross-section through an edge zone of a composite window.

DESCRIPTION OF THE PREFERRED EMBODIMENTS

First and second glass panes are respectively referenced 11 and 12 and are connected by a bridge 13 known per se, and whose interior is filled with a molecular sieve. Between the projecting glass panes 11 and 12, the exterior of the bridge 13 is filled with an adhesive.

The inside 131 of the bridge 13, which faces towards the interior between the glass panes 11, 12, is provided with two grooves 1311, 1312 which are arranged at an interval from one another and which have an identical, dove-tailed cross-section. They extend along the entire length of the bridge parallel to the surfaces of the glass panes 11, 12.

A spacer structure 2 is attached to the inside 131 of the bridge 13. The spacer structure 2 consists of first and second profiled components: each profiled component including a mounting flank 211, 212 which, on its side facing towards the bridge 13, is provided with a prismatic component 2110, 2120, and whose cross-section is selected to be such that it fits exactly into one of the dove-tailed grooves 1311, 1312 of the bridge 13. On the side facing towards the bridge 13, each mounting flank is provided with two supporting lugs 200 on either side of the prismatic component and at an interval therefrom. The supporting lugs, and likewise the dimensions of the prismatic component and groove, are designed such that the inclined surfaces of the prismatic component abut against the inclined surfaces of the groove in a resilient fashion.

The first profiled component which comprises the mounting flank 212 has two guide flanks 202, 203, the faces of which extend in parallel to those of the glass panes 11, 12 and between which a first prismatic plate 31 is float-mounted.

The second profiled component has an L-shaped cross-section and has only one guide flank 201 which extends at right angles away from the mounting flank 211 and extends parallel to the surface of the second glass pane 12. Together with the flank 202 of the first profiled component, this flank 201 likewise forms a groove in which a second profiled prismatic plate 32 is float-mounted.

Although various minor changes and modifications might be proposed by those skilled in the art, it will be understood that we wish to include within the claims of the patent warranted hereon all such changes and modifications as reasonably come within our contribution to the art.

We claim as our invention:

1. A composite window, comprising:

first and second glass panes;

means connecting the first and second glass panes to one another at edges of the glass panes in sealed fashion, said means comprising a bridge enclosing an interior space between the glass panes;

a spacer structure having a mounting flank attaching the spacer structure to an inner side of the bridge which faces towards said interior space, and also having at least two spaced apart guide flanks extending from the mounting flank in a direction away from the bridge and parallel to the glass panes;

at least one prismatic plate float-mounted between the at least two guide flanks so as to permit thermally dependent longitudinal expansion of the plate;

said inner side of the bridge having at least one groove with a dove-tailed cross-section and which has a longitudinal extent parallel to the glass panes; and on a side facing towards the bridge, the mounting flank of the spacer structure having a prismatic component whose cross-section is similar to that of the at least one groove, said prismatic component fitting into and being received by the groove so as to attach the mounting flank and associated spacer structure to the bridge.

2. A composite window according to claim 1 wherein said spacer structure is comprised of first and second profile components, the first profile component having a mounting flank and two spaced apart guide flanks and the second profile component having one mounting flank and one guide flank.

3. A composite window according to claim 2 wherein each profile component has a prismatic component and said bridge has two of said dove-tailed cross-section grooves, each receiving a respective one of the prismatic components of the associated profile components, the two grooves being spaced apart on the bridge such that said first and second profile components are directly adjacent to one another, and wherein first and second prismatic plates are provided, the first prismatic plate being received between the guide flanks of the first profile component and the second prismatic plate being received between one of the guide flanks of the first profile component and the guide flank of the second profile component.

4. A composite window according to claim 1 wherein said mounting flank of said spacer structure has first and second supporting lugs on opposite sides of said prismatic component, a projection height of the supporting lugs and dimensions of the groove and prismatic component being provided such that inclined surfaces of the groove and prismatic component abut against one another in a resilient fashion.

5. A composite window according to claim 1 wherein said spacer structure is comprised of at least two profile components, each of them having a mounting flank and at least one guide flank, the inner side of the bridge having one groove for each profile component, the grooves being spaced apart on the bridge such that the profile components are directly adjacent to one another.

6. A composite window, comprising:

first and second glass panes;

bridge means connecting the first and second glass panes to one another at edges of the glass panes in sealed fashion so as to at least partially enclose an interior space between the glass panes;

a spacer structure having a mounting flank attaching the spacer structure to an inner side of the bridge which faces towards said interior space, and also having at least two spaced apart guide flanks extending outwardly from the mounting flank away from the bridge and parallel to the glass panes;

at least one plate having its edge freely received between the at least two guide flanks so as to allow free movement thereof;

said inner side of the bridge having at least one retaining groove with an angled cross-section and which extends parallel to the glass panes; and on a side facing towards the bridge and inwardly of the guide flanks, the mounting flank of the spacer structure having a component whose cross-section is similar to that of the at least one groove, said prismatic component fitting into and being received by the groove so as to attach the mounting flank and associated spacer structure to the bridge.

* * * * *